US006938886B2

(12) United States Patent
Glucksman

(10) Patent No.: US 6,938,886 B2
(45) Date of Patent: Sep. 6, 2005

(54) APPARATUS FOR CONDITIONING AIR

(75) Inventor: Dov Z. Glucksman, Wenham, MA (US)

(73) Assignee: Appliance Development Corporation, Danvers, MA (US)

( * ) Notice: Subject to any disclaimer, the term of this patent is extended or adjusted under 35 U.S.C. 154(b) by 0 days.

(21) Appl. No.: 10/446,177

(22) Filed: May 27, 2003

(65) Prior Publication Data

US 2004/0004299 A1 Jan. 8, 2004

Related U.S. Application Data

(63) Continuation-in-part of application No. 09/571,351, filed on May 16, 2000, now abandoned.

(51) Int. Cl.[7] ..... B01F 3/04

(52) U.S. Cl. ..... 261/129; 261/133; 261/142; 261/DIG. 10; 392/405; 392/406

(58) Field of Search ..... 261/129, 130, 261/133, 142, DIG. 10, DIG. 29; 202/83, 176, 185.5, 267.1, DIG. 1; 392/405, 406

(56) References Cited

U.S. PATENT DOCUMENTS

| | | | | |
|---|---|---|---|---|
| 2,576,110 A | | 11/1951 | Fisher | 261/142 |
| 3,982,095 A | | 9/1976 | Robinson | 261/142 |
| 4,657,713 A | | 4/1987 | Miller | 261/142 |
| 4,818,344 A | | 4/1989 | Glucksman | 202/176 |
| 4,869,853 A | | 9/1989 | Chen | 261/142 |
| 4,921,642 A | | 5/1990 | LaTorraca | 261/142 |
| 5,014,338 A | | 5/1991 | Glucksman | 392/405 |
| 5,131,070 A | * | 7/1992 | Chiu et al. | 392/405 |
| 5,339,383 A | | 8/1994 | Marino | 392/406 |
| 5,343,551 A | | 8/1994 | Glucksman | 392/405 |
| 5,361,322 A | | 11/1994 | Glucksman | 392/405 |
| 5,636,319 A | | 6/1997 | Glucksman | 392/406 |
| 5,835,680 A | | 11/1998 | Glucksman et al. | 392/501 |
| 6,226,451 B1 | | 5/2001 | Wong | 392/405 |
| 6,275,652 B1 | | 8/2001 | Chauviaux | 392/405 |
| 6,314,237 B1 | | 11/2001 | Glucksman | 392/405 |

FOREIGN PATENT DOCUMENTS

| | | |
|---|---|---|
| JP | 1-150726 | 6/1989 |
| JP | 5-52372 | 3/1993 |

OTHER PUBLICATIONS

Website www.slantfin.com/consumer/prod–gf350.html.
Website www.healthandhouse.com/healthandhouse/gerwarmishum1.html.
Website ://store2.yimg/l/healthandhouse_1747_527194.

* cited by examiner

*Primary Examiner*—Scott Bushey
(74) *Attorney, Agent, or Firm*—George A. Herbster

(57) ABSTRACT

A humidifier including a steam generator with a container for water and an immersed heating module. The heating module has a spherical shape and is formed of a stainless steel outer surface and an aluminum inner body. Electrical heating coils are affixed to the aluminum body to heat the aluminum body and transfer heat through the stainless steel into water. The composite of the inner and outer bodies provides efficient heat transfer for boiling water. The stainless steel resists any permanent adherence of residue to the heating module during the boiling process. Steam from the boiling water transfers through a mixing stack to surrounding air in the humidifier.

26 Claims, 14 Drawing Sheets

APPARATUS FOR CONDITIONING AIR

CROSS REFERENCE TO RELATED APPLICATION

This application is a continuation-in-part of my application Ser. No. 09/571,351 filed May 16, 2000 for Apparatus for Humidifying Air Distilling Water (now abandoned).

BACKGROUND OF THE INVENTION

1. Field of the Invention

This invention generally relates to apparatus that can be used to humidify air and more specifically to apparatus that uses an immersion heater for converting liquids into gas as, for example, by generating steam for use in humidifiers.

2. Description of Related Art

Humidifiers, distilling apparatus and like apparatus use immersion heaters to convert a liquid, such as water, into vapor or steam by boiling water. In humidifiers the steam mixes with air and disperses throughout a room to increase relative humidity. In a distilling apparatus a condenser receives the steam to produce distilled water.

There are many embodiments of such apparatus. Generally, however, warm mist humidifiers and distilling apparatus include some type of immersion heater. Characteristically over time deposits or residues from the water adhere to the surface of such immersion heaters. More specifically, water available through various municipal and other supplies contains minerals that do not evaporate along with the water. Certain of these minerals, especially lime, adhere to the heat transfer area, namely to the outer surface of the immersion heater. As the residue accumulates, the heat transfer rate to the water decreases with two adverse effects. First, the process by which the boiling occurs becomes less efficient. Secondly, the heating coils operate at a higher temperature. Moreover, as also known, the residue becomes more difficult to remove after it accumulates over time.

U.S. Pat. No. 5,343,551 (1994) to Glucksman discloses one embodiment of an immersion heater used with a portable air humidifier. A housing contains an evaporation chamber in the shape of an inverted cup. The chamber has a steam outlet in its top and an electric heating element positioned a short distance above an open bottom. In this particular humidifier a blower delivers cool air through a duct to communicate with the evaporation chamber through its steam outlet to blow humidified air back into the room. Water from a main compartment or tank transfers to a compartment in a removable tray that allows ready access to the compartments for cleaning.

U.S. Pat. No. 4,818,344 (1989) to Glucksman discloses a water distilling apparatus with a vaporization chamber containing an electric coil heating element, a fin tube condenser coil and an electric fan for cooling the surfaces of the condenser coils. An electric coil heating element vaporizes water and the resulting steam travels through the condenser tubing where it is reconverted to pure water and delivered to a beaker through a water outlet. Various portions of this device can be removed for cleaning sediments and residues.

U.S. Pat. No. 5,835,680 (1998) to Glucksman et al. discloses an immersible heater with an annular collar that spaces a heating element above a bottom wall of the structure. The collar acts as an insulator thereby to limit the heat transferred to the bottom wall that is typically formed of a plastic material. In addition, a thermostat monitors the temperature of the heater. When the water is nearly evaporated, the thermostat or a backup thermofuse turns off the heater. This occurs while water still surrounds at least the collar and therefore further prevents damage from overheating.

In another humidifier sold by Slant Fin a stainless steel cup holds water to be boiled. A heating coil attaches to the exterior of the cup and heats the water in the cup to the boiling point. The interior of the cup is more readily cleaned than prior cups. However, like the other devices described above, it is necessary to handle an entire base unit. However, such base units generally contain electrical components. It is generally recommended that they not be immersed in water or cleaned in a dishwasher.

Each of the foregoing patents discloses a humidifier or water distilling apparatus on which it is difficult to remove and clean residue that adheres to the heating element. The use of stainless steel cups reduces the effort required to clean a heating element. However, such heating elements are usually integral with a base unit and hard to reach. In others the heater is made more accessible. However an entire base unit must be moved to a sink or other cleaning area. The base unit generally includes electrical components so it can not be immersed in water. Consequently, individuals do not clean such devices on a regular basis even though this means that the operating efficiency for the apparatus is degraded.

Prior apparatus, particularly prior humidifiers, have other operating deficiencies. For example, a requirement to heat large volumes of water increases the time that lapses between the application of power to and the generation of steam by the humidifier. Large volumes of water also can pose a risk if the humidifier tips and discharges hot water as all the water is heated and potentially injurious. In others, the boiling process can cause spurts of hot water to eject from the humidifier causing proximate furniture or carpets to become soiled.

SUMMARY

Therefore it is an object of this invention to provide apparatus with an immersible heater that cleans easily.

Another object of this invention is to provide an apparatus with an immersible heater that cleans easily thereby to enable more efficient operation.

Still another object of this invention is to provide an apparatus with an immersible heater that cleans easily by enabling a heating unit to be immersed in water.

Yet another object of this invention is to provide an apparatus with an immersible heater that overcomes many of the operating disadvantages of prior art devices.

Still yet another object of this invention is to provide an apparatus with an immersible heater that cleans easily, that overcomes many of the operating disadvantages of the prior art and yet is economical to manufacture.

Yet still another object of this invention is to provide an apparatus with a removable immersible heater that cleans easily and is easy to use.

Another object of this invention is to provide a humidifier that cleans easily to enable more efficient operation by allowing a heating unit to be immersed in water for cleaning and that overcomes many operating disadvantages of prior art humidifiers.

Another object of this invention is to provide a water distilling apparatus that cleans easily to enable more efficient operation by allowing a heating unit to be immersed in water for cleaning and that overcomes many operating disadvantages of prior art water distilling apparatus.

In accordance with this invention a device that produces steam comprises a base unit, a water tank, a removable steam generator and a steam director. The base unit includes power connections and controls, a first and second receiving stations. The water tank unit has a valve for allowing water to exit the water tank when the water tank is installed at the receiving station. The removable steam generator is housed in the second receiving station and includes a container that receives water in a boiling chamber, an aqueduct for directing water from the water tank to the boiling chamber, a semispherically shaped immersion heater in the boiling chamber and a sealing structure for attaching the immersion heater to the container. Steam is directed from the steam generator to an output of the device.

In accordance with another aspect of this invention, a humidifier comprises a base unit that carries a detachable water tank unit, a removable steam generator and a detachable mixing stack. The base unit includes power connections and controls, first and second receiving stations. The water tank unit has a valve for allowing water to exit the water tank when the water tank is installed at the first receiving station. The steam generator is positioned at the second receiving station and includes a container that receives water, an immersion heater attached to the container, a chimney with a first end that circumscribes the immersion heater to define a boiling chamber and a second end with an exhaust opening, and means for conveying water from the water tank to the boiling chamber. The mixing stack has a first end that circumscribes the chimney and an exhaust opening at a second end thereof whereby steam from the chimney mixes with air in the stack to be discharged as humidified air from the exhaust opening.

In accordance with another aspect of this invention a humidifier comprises a support assembly and a removable upper assembly. The support assembly has a base unit with first and second displaced receiving portions. A steam generator is located at the second receiving position. The removable upper assembly includes a shroud, a water tank unit and a mixing tube. The shroud engages the support assembly in a predetermined relationship and has a port at an upper portion thereof. The water tank unit connects to the shroud for alignment with the first receiving position of the support assembly. The mixing tube extends from the port to align with the steam generator and is external to the water tank unit. This structure allows the upper assembly to be readily removed from the support assembly for filling the water tank unit and cleaning the steam generator.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
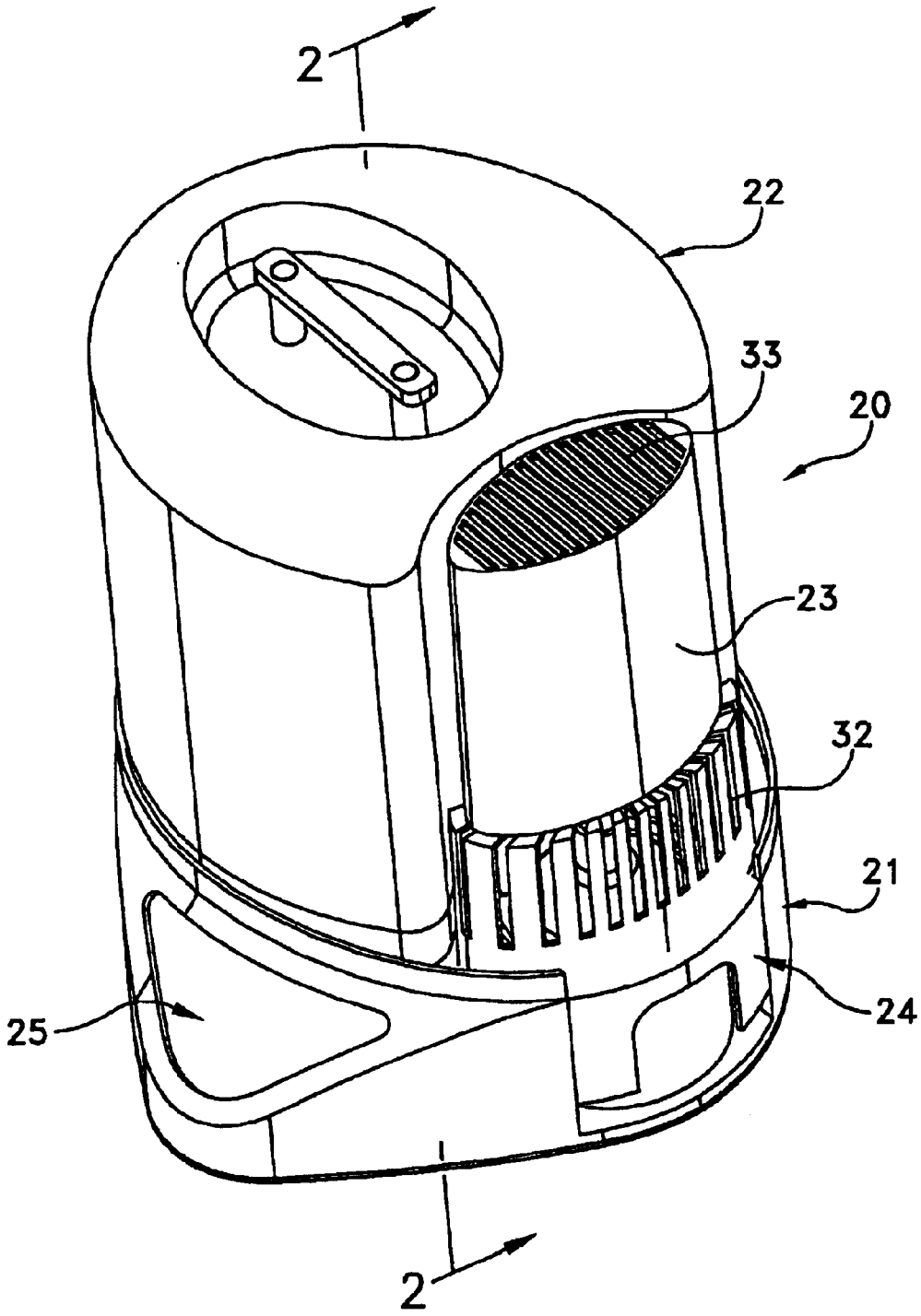
FIG. 1 is a perspective view of warm mist humidifier that incorporates this invention.

FIG. 1 depicts a first embodiment of warm mist humidifier 20. This particular warm mist humidifier includes a base unit 21, a water tank unit 22, a mixing stack 23 and a removable steam generator assembly 24. A control panel 25 includes an on/off switch, operating lights and other components (not shown) as necessary.

Figure 2:
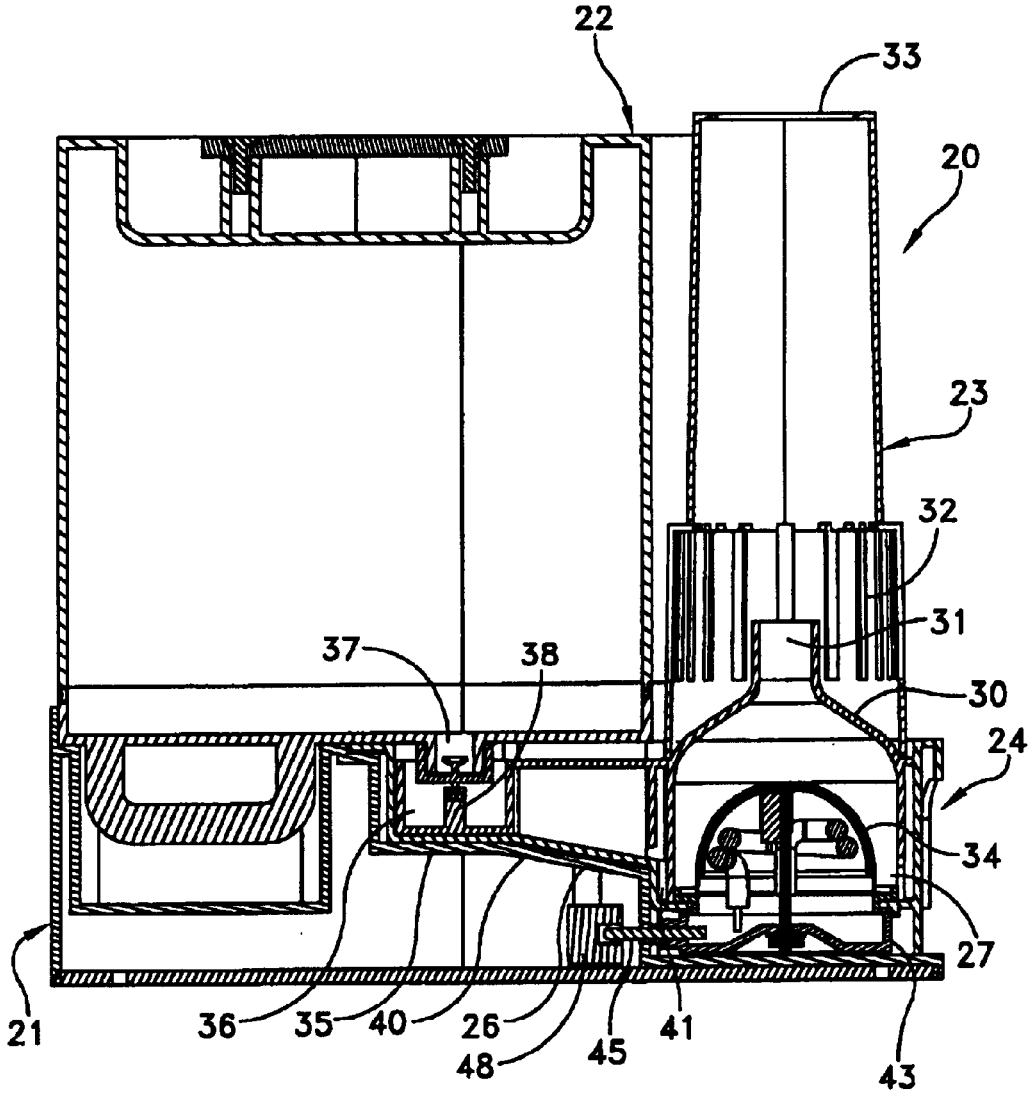
FIG. 2 is a cross-sectional view of the humidifier shown in FIG. 1.

Referring to FIGS. 1 and 2, the removable steam generator assembly 24 includes a steam generator 26 that contains water collected in a boiling chamber 27 located within the confines of a generally cylindrically shaped steam dome or chimney 30 that also supports the mixing stack 23. As shown most clearly in FIG. 2, the steam dome or chimney 30 is removable and can be formed of a number of materials including a talc-filled polypropylene. The chimney 30 additionally includes an output 31 with a funnel shape that allows the steam to form a high velocity jet. As the jet moves vertically upward in FIG. 2, it provides an area of reduced pressure allowing room air to enter the mixing stack 23 through air intake openings 32. The mixed air and steam then exit through exhaust openings 33 at the top of the mixing stack 23.

Figure 3:
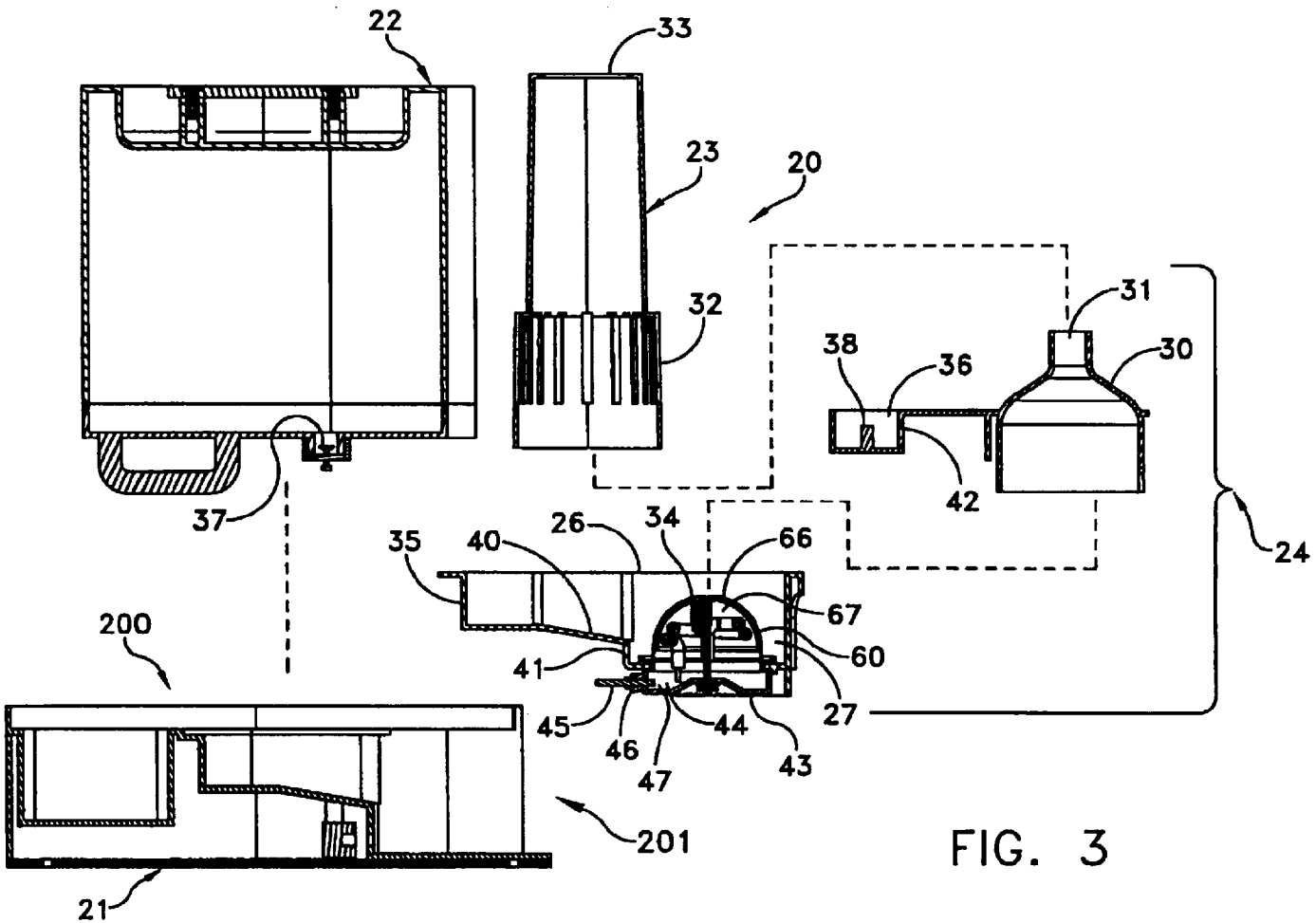
FIG. 3 is an exploded view of the components of the humidifier shown in FIG. 2.

FIG. 3 depicts the warm mist humidifier 20 as it can be disassembled for cleaning. First the water tank unit 22 can be readily removed from a receiving position 200 on the base unit 21. After the mixing stack 23 is removed, the removable steam generator assembly 24 can be slid from the base unit 21, to the right in FIG. 2, along support rails that are not shown from a second receiving position 201. However, the construction of such support rails is well known in the art. When the removable assembly 24 is outside the base unit 21, the chimney or steam dome 30 can be lifted from the removable steam generator assembly 24. The remaining portion constitutes the steam generator 26 with a heating module 34.

The steam generator 26 includes an open container 35 that receives water from the water tank unit 22. That is, when the humidifier 20 is assembled with the water tank unit 22 at the first receiving position 200, water flows down a sloped surface 40 into a reservoir 41 and then into the boiling chamber 27. As shown more clearly in FIG. 2, the chimney 30 carries a well 36 that is positioned under a conventional release valve 37 formed in the bottom of the water tank 22. When the well 36 is in place, a central pedestal 38 elevates the valve 37 and allows water to transfer through a base passage 42 in the well 36 and onto the slope 40 so that this portion of the open container 35 acts as an aqueduct.

As can be seen in FIG. 3 and described in more detail later, the heating module 34 provides a substantially semi-spherical surface within the boiling chamber 27. As known, the boiling process begins when a small bubble of steam is formed at a heated surface or wall. As more heat flows into the area, the bubble grows as more water evaporates. When the heat bubble attains a size where its buoyancy overcomes the adhesion force between it and the heated surface, the bubble detaches from the heated surface and floats rapidly to the top of the water surface and rises into the atmosphere as water vapor or steam. However, as the steam bubble is being formed and grows, the rate of heat transfer into the steam bubble diminishes because the heat transfer coefficient into air is less than into water. Thus while the steam bubble is attached to the heat transfer surface, the temperature of the heated surface rises since heat is not being carried away. With a flat horizontal heating surface, bubbles grow to a fairly large size before they detach themselves from the heating surface. Consequently the heating surface runs at a higher average temperature during a boiling process. This limits the amount of heat that can be generated on a per unit area. Heating along a vertical surface, however, is more effective in terms of the ability to generate high heat flux because the bubbles more easily detach themselves from the vertical heating surface.

Experiments have led to the conclusion that a semispherical shape is an optimal shape because the surface area is maximized in relationship to the volume of the heating element. Yet the steam bubbles still easily separate from a spherical surface with an efficiency to be expected from a vertical surface.

Figure 4:
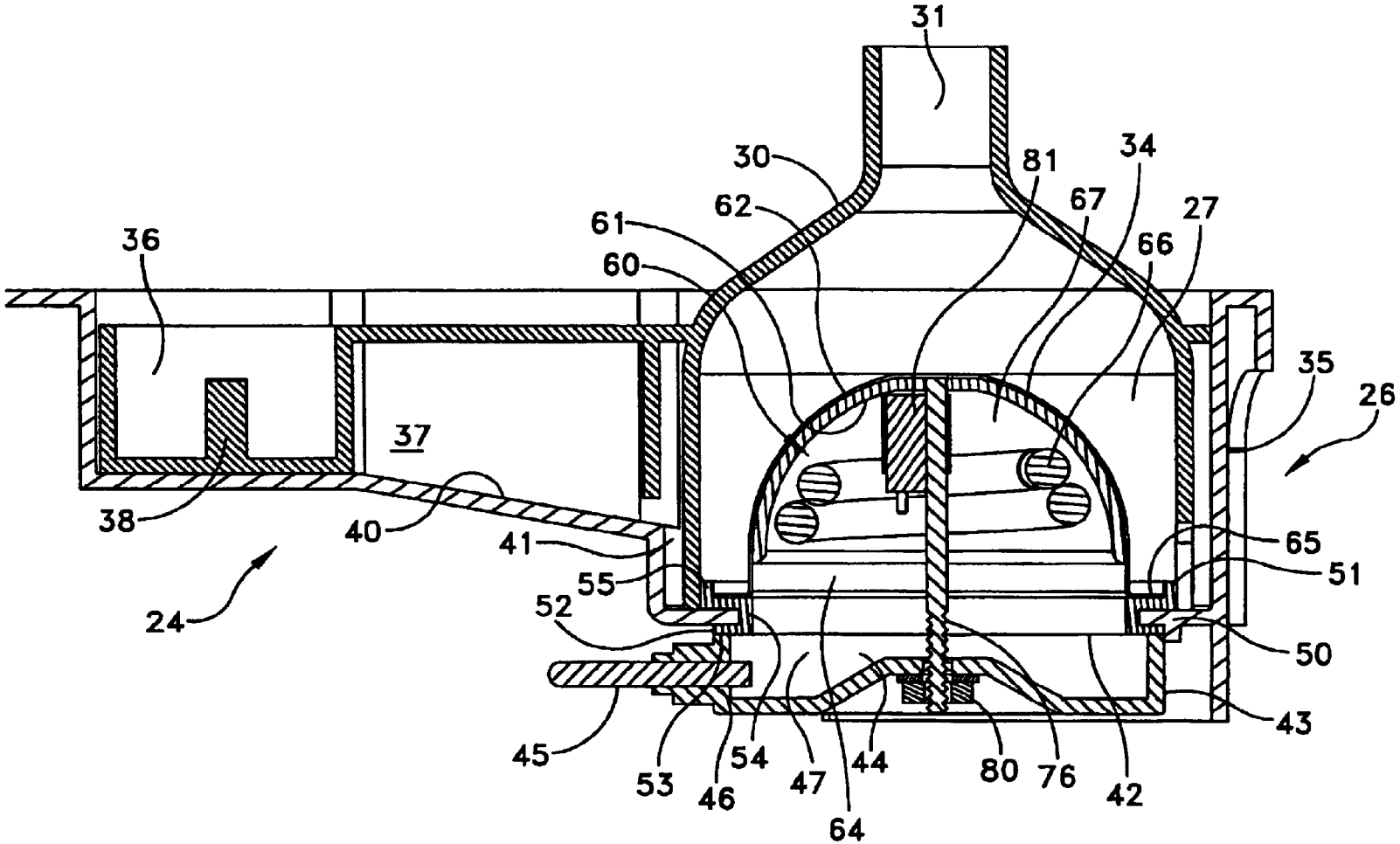
FIG. 4 is a cross-sectional view of a removable steam generator for use in the humidifier of FIG. 1.
Figure 5:
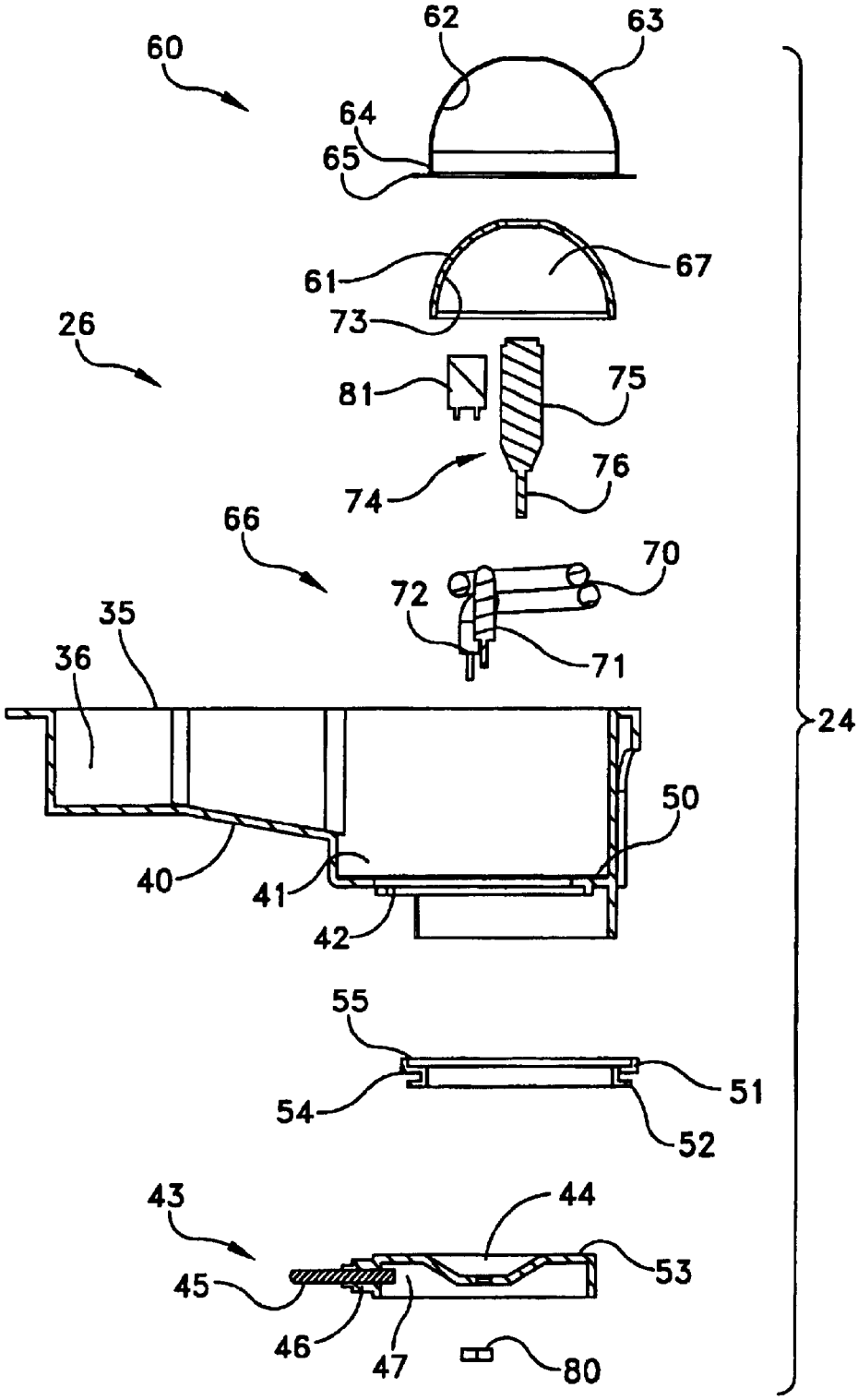
FIG. 5 is an exploded view of the removable steam generator constructed in accordance with this invention.

Referring now to FIGS. 4 and 5, the open container 35 has a bottom opening 42. The heating module 34 spans that opening and includes a lower base unit 43 that defines a cavity 44. A male plug 45 extends through a wall 46 and terminates with an internal connector 47 within the cavity 44. The cavity 44 serves as a site for any electrical connections that need to be made to other portions of the heating module 34. When the removable steam generator assembly 24 is seated in the reservoir 41 in FIG. 3, the male plugs 45 engage a terminal block 48 in FIG. 2 that is powered from a cord (not shown) through a control that generally will include the switch on the control panel 25. As will now be apparent, this construction allows the heating module to be separated from the controls for cleaning.

An inwardly extending lip 50 defines the opening 42 through the container 35. A conventional seal 51 engages the lip 50 and seals the heating module 34 to the container 35 at the bottom opening 42. More specifically, the seal 51 has a bottom leg 52 that lies on a bottom surface of the lip 50 and that is interposed between an upper edge 53 of the base unit 43 and the lip 50. An intermediate leg 54 lies between a top surface of the lip 50 and the lower surface of the heater flange 65. An upper leg 55 lies along the upper face of the heater flange 65 and completes the seal.

The heart of the heating module 34 is a heating element 60 with a first body 61 and a second overlying body 62. The first body is relatively thick in a radial direction. It is formed from the group of materials having a high heat transfer coefficient. Deep drawn aluminum, for example, produces a very satisfactory first body 61. The body 61 has a cup shape or essentially semispherical form. The second body 62 has a first portion 63 that overlies and is coextensive with the first body 61. The material of the second body 62 is taken from a group of materials that inhibit the permanent adherence of residue to their surfaces. Typically these materials have a heat transfer coefficient that is less than the coefficient that characterizes the first body 61. In the preferred embodiment, the second body 62 comprises a drawn, thin stainless steel body.

As will become apparent later, this characteristic is used to advantage in the construction of the heating element 60 and steam generator 26. The overlying portion 63 intimately contacts the outer surface of the first body 61; typically the two bodies will be brazed together. In addition, the second body has a skirt extension 64 that spaces the first body 64 from other components of the steam generator.

Some electrical codes may require double insulation of electrical devices of the type that includes the vapor generator of this invention. The specific structure of the second body 62 is readily adapted to meet such requirements. It is merely necessary to assure that all the exposed portions of the second body 62 have a coating of a dielectric material that inhibits the permanent adherence of residue to the coated second body 62. Teflon is an example of a readily available coating material. Coating stainless steel, rather than some other material, is still desirable in order to maintain the support and thermal insulating functions of the skirt 64.

Referring particularly to FIG. 4, the skirt portion 64 of the second body 62 spaces the first body 61 from the seal 51, the lip 50 and the lower base unit 43. This configuration provides an advantage primarily because the second body 62 is very thin. As the first body 61 heats, heat transfers radially from the first body 61 through the second body 62 to water in an efficient manner because the heat transfer path is transversely through the thin radial dimension of the body 62. This path has a large cross sectional area and short length. However, the heat transfer path to the seal 51 includes the skirt 64. The cross-sectional area for this path is very small because the skirt 64 is thin. This path is also relatively long. Consequently, this path through the skirt 64 minimizes any heat transfer to the flange 65 and the surrounding seal thereby thermally isolating the heating element 60 from other plastic structures so they remain cool during normal operations.

As will now be evident, this structure further facilitates cleaning. First, the container 35 and heating module 34 are readily accessible from the top as shown in FIG. 3 for cleaning any residue from the container walls and surfaces or from the surface of the heating module 34. Any residue will accumulate on the outer surface of the second body 62. However, residues do not adhere strongly to the surfaces of stainless steel or other similar materials, so the surface is easily scrubbed. Typically the steam generator 26 with its container 35 and heating module 34 can be cleaned in a dishwasher. In more severe cases, vinegar or other decalcifying solutions might be placed in the container 35 before cleaning. As will be evident, it is not necessary to carry the entire base unit 21 to a sink for cleaning.

The heating module 34 also has a heating element 66 in a cavity 67 formed in the first body 61. In this particular embodiment the heating element 66 has a two-turn sheathed heating element coil 70 formed from an electrical resistance heating element; such heating elements are known in the art. End terminations 71 and 72 are formed to be substantially parallel to each other and to a vertical axis in FIG. 5. The two-turn coil 70 attaches to the interior surface of the first body 61 toward the base thereof as is particularly shown in FIGS. 3 and 4. Brazing is the preferred method of attachment. This assures a good heat transfer path from the coil 70 to the first body 61.

As shown in FIGS. 4 and 5, the interior surface of the first body 61 near its top portion includes an anchor 74 for receiving a plate 75 that extends axially and terminates in a threaded axial extension 76. The threaded extension 76 extends downwardly beyond the cavity 67. The flange 65 is captured between the intermediate and top legs 54 and 55 of the seal 51. Thus as particularly shown in FIG. 4, when the heating module 34 is mounted, the threaded extension 76 passes into the cavity 44 defined by the base unit 43. A nut 80 tightens onto the threaded extension 76 and clamps the heating element 60 and base unit 43 together and to the inwardly extending lips 50. Consequently the seal 51 isolates the cavity 47 from any liquid in the reservoir 41.

In addition, the terminal extensions 70 and 71 extend downwardly into the cavity 44 so that connections between the terminations 70 and 71 and the male plugs, such as the male plug 45, can be made in the cavity 44 in isolation from any liquid in the container 35.

With this construction the immersion of the heater module 34 in a sink or dishwasher after its removal from the steam generator will have no deleterious effect. That is, even when completely submerged, water will not penetrate the seal 51 so the electrical connections in the cavity 44 and cavity 67 remain dry. As a result, cleaning the heating module 34 including the exterior of the stainless steel body is readily achieved by placing the heater module in a dishwasher.

The plate 75 also carries a thermostat 81 and may carry a thermofuse (not shown, but known in the art). A thermostat 81 is, as shown particularly in FIGS. 4 and 5, located near the top of the first body 61. This becomes a device that senses a low water condition. When water is being boiled, sufficient heat is being withdrawn from the aluminum body 61 so that its temperature remains below a predetermined level. However, when the water falls below a certain level, the heat does not radiate into the air so efficiently. Consequently the temperature of the first body 61 rises. The thermostat 81 senses this temperature rise and, directly or indirectly, interrupts any current to the heating coil 70.

Therefore the humidifier in FIGS. 1 through 5 meets various objectives of this invention. Specifically, it cleans easily because it disassembles into readily accessible components, namely: the base unit 21, the water tank unit 22 at the first receiving position 200, the mixing stack 23 and the removable steam generator assembly 24 at the second receiving position 201. Moreover, the removable steam generator 24 further separates into a steam generator 26 and steam dome or chimney 30. The steam dome or chimney 30 is a molded plastic part with no moving or electrical components. The steam generator includes an electrical component in the form of the heater module 34. However, the heater module 34 is sealed. In a humidifier it is likely that the residue will deposit only on the steam dome 30 and the steam generator 26. Given their respective constructions, each can be placed in a dishwasher. The washing action generally will clean all deposits from the plastic parts and the stainless steel surface of the heater module. As will also be apparent, these components can be submerged to facilitate hand washing. A further result of easy cleaning lies in an individual's willingness to be more likely to clean such parts on a regular basis. Regular cleaning will increase the overall operating efficiency of the humidifier.

This humidifier also overcomes operating disadvantages of the prior art. The boiling chamber 27 has a limited volume, and the water path into the boiling chamber 27 is restricted. Consequently, hot water tends to be restricted to the volume of only the heating chamber. This minimizes the volume of water that is heated at any given time and reduces the time that lapses between the application of power and the generation of steam. Moreover, the steam dome 30 has an output 31 of a reduced diameter. If the humidifier 20 were inadvertently tipped onto its side, only a portion of the water in the boiling chamber would escape through the output 31. Consequently, this design tends to limit any risk that might be caused by scalding should such an inadvertent tipping occur.

If during the process water spurts upward from the boiling chamber 27, most will strike or condense on the steam dome 30 and return to the boiling chamber 27. It is highly unlikely that any significant spurts would pass completely through the reduced diameter outlet 31 and upward through the mixing stack 23 to exit the device. Consequently, scalding or physical damage by such spurting is highly unlikely.

The use of the heater module 34 with its stainless steel skirt 64 reduces heat transfer to adjacent plastic parts. This enables the relaxation of the temperature criteria for the plastic parts. As a general rule the cost for plastic resins decreases with reduced temperature requirements. Thus the humidifier shown in FIGS. 1 through 5 can be less costly to manufacture.

Figure 6:
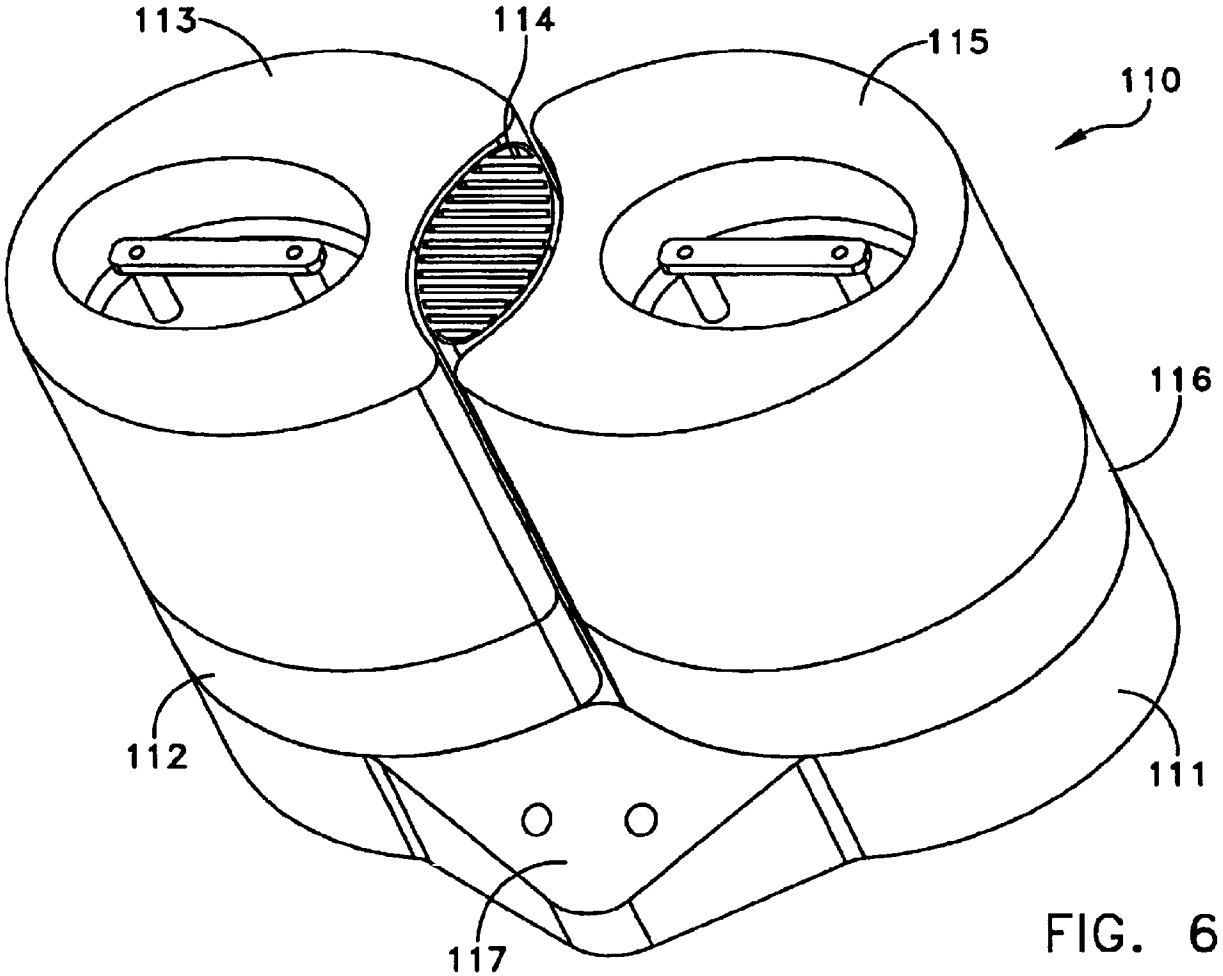
FIGS. 6 and 7 depict an alternate embodiment of a humidifier constructed in accordance with this invention.
Figure 7:
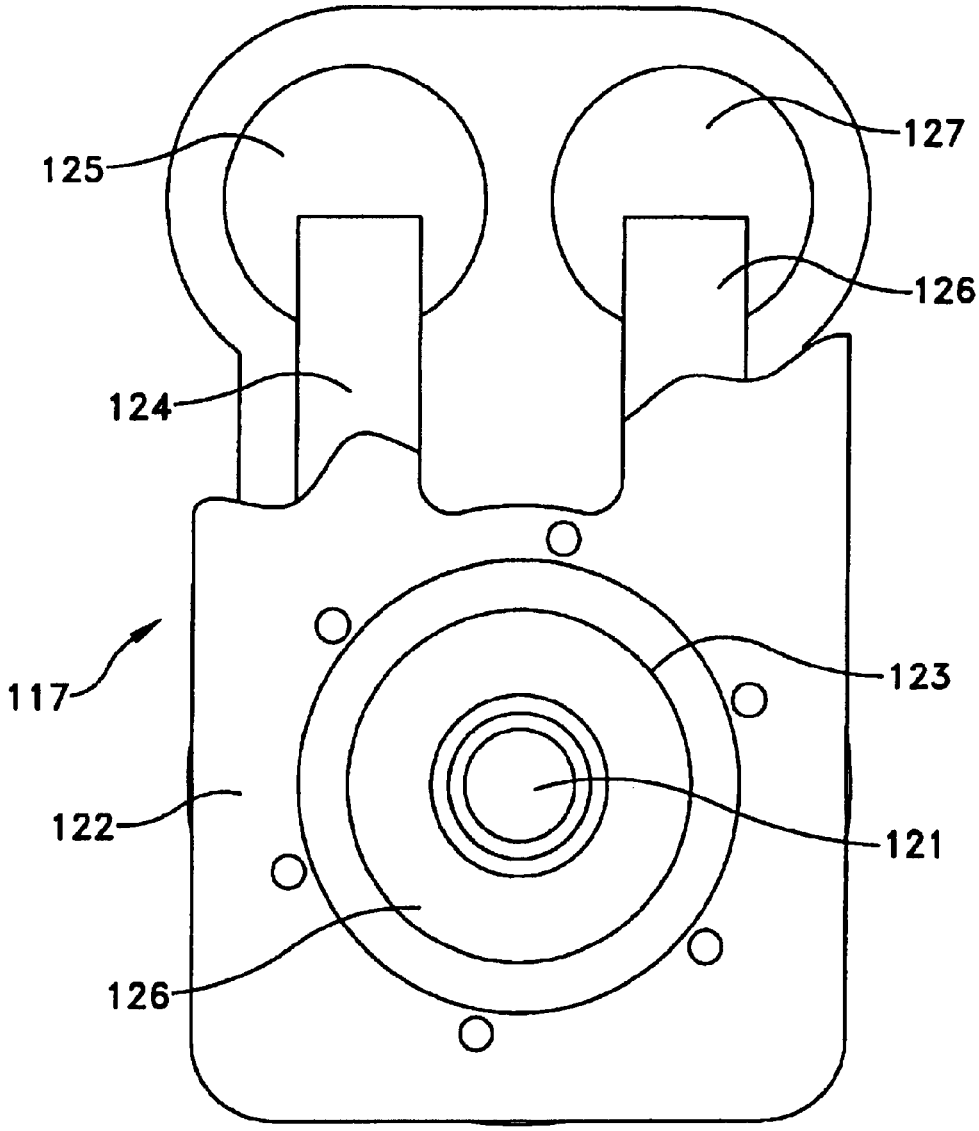

FIG. 6 depicts another embodiment of a humidifier that incorporates this invention. In this specific example, a humidifier 110 contains multiple tanks. More specifically, a base unit 111 includes a receiving position 112 that receives a water tank 113. A mixing stack 114 is positioned intermediate the water tank 113 and a second tank 115 that seats in another receiving position 116 in the base unit 111. The base unit 111 also carries a removable steam generator apparatus 117 at another receiving position. FIG. 7 depicts such a steam generator for use in the apparatus 115 that is a modification of the steam generator 26 shown in FIGS. 1 through 5. In this case, the steam generator apparatus 117 includes a steam dome 121. Like the steam dome 30 in FIGS. 1 through 5, the steam dome 121 has a cylindrical bottom cross-section and a reduced diameter top exhaust 121. A bottom section 122 defines a boiling chamber and circumscribes the heating module 123 that is constructed as the heating module 34 previously described with respect to FIGS. 1 through 5.

In this embodiment the steam dome 121 contains two parallel arms. A first arm 124 extends from the bottom section 122 to a well 125. The second arm 126 terminates at a well 127. When the removable steam generator assembly 117 is properly located at its receiving position within the base unit 111, the well 125 is below the valve for the water tank 113; the well 127, below the valve for the water tank 115.

As is known in such a system both water tanks can be filled and one will typically empty before the other. In either case, the construction surrounding the boiling chamber is as shown in FIG. 5 so water passes from each of the wells into the boiling chamber in the same manner as it would in FIGS. 1 through 5.

Figure 8:
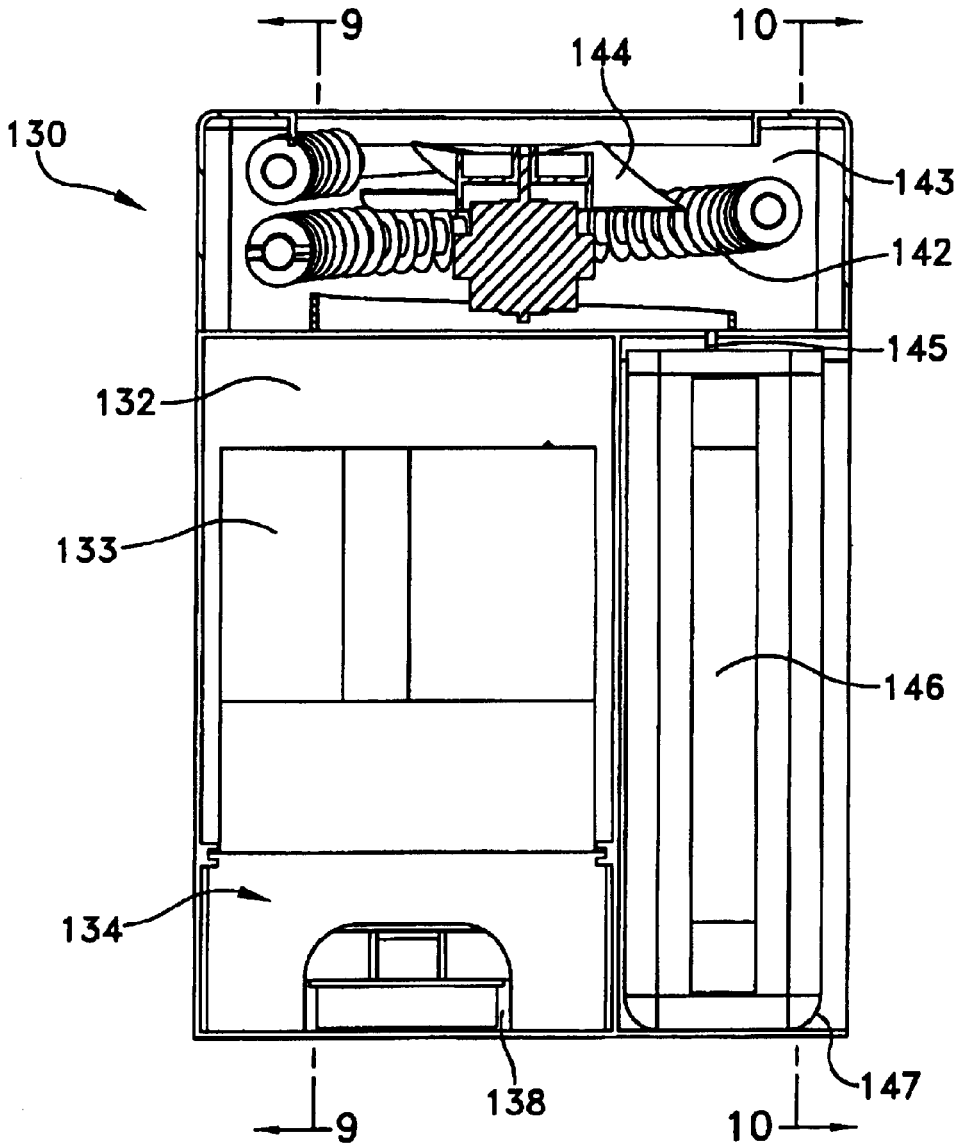
FIG. 8 depicts water distilling apparatus constructed in accordance with this invention.
Figure 9:
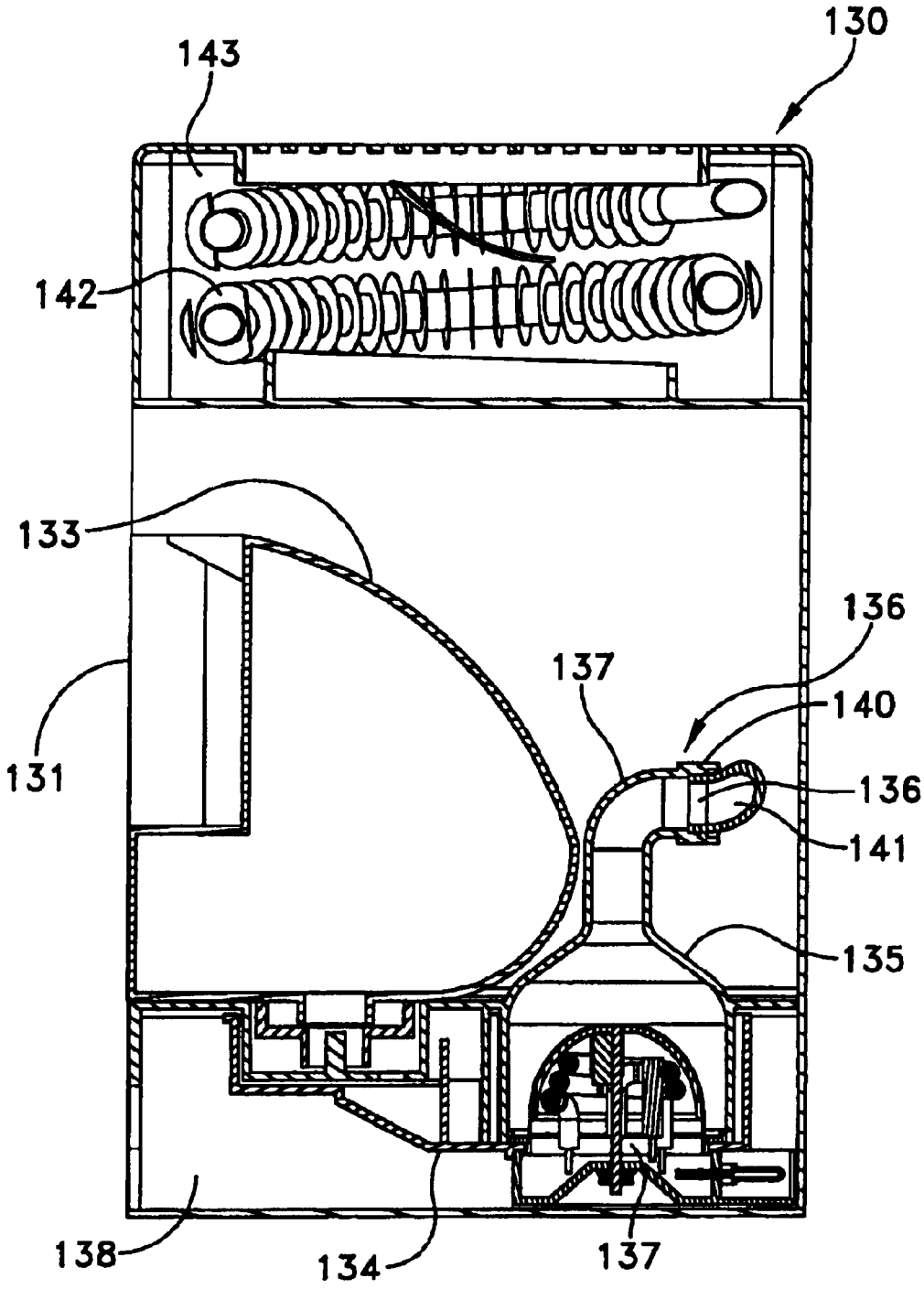
FIG. 9 is a cross-sectional view of the water distilling apparatus of FIG. 8 taken along lines 9—9.
Figure 10:
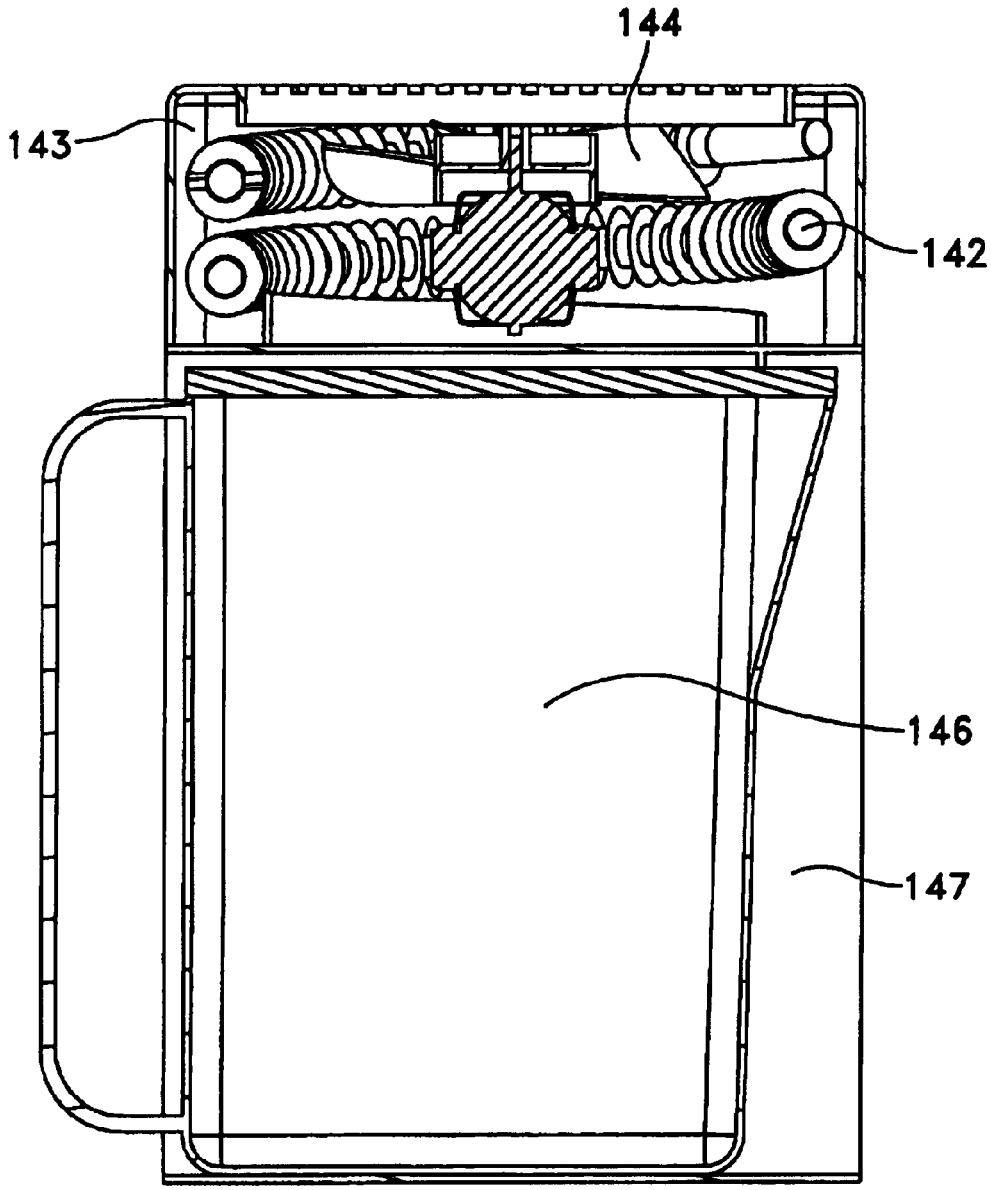
FIG. 10 is a cross-sectional view of the water distilling apparatus of FIG. 8 taken along lines 10—10.
Figure 11:
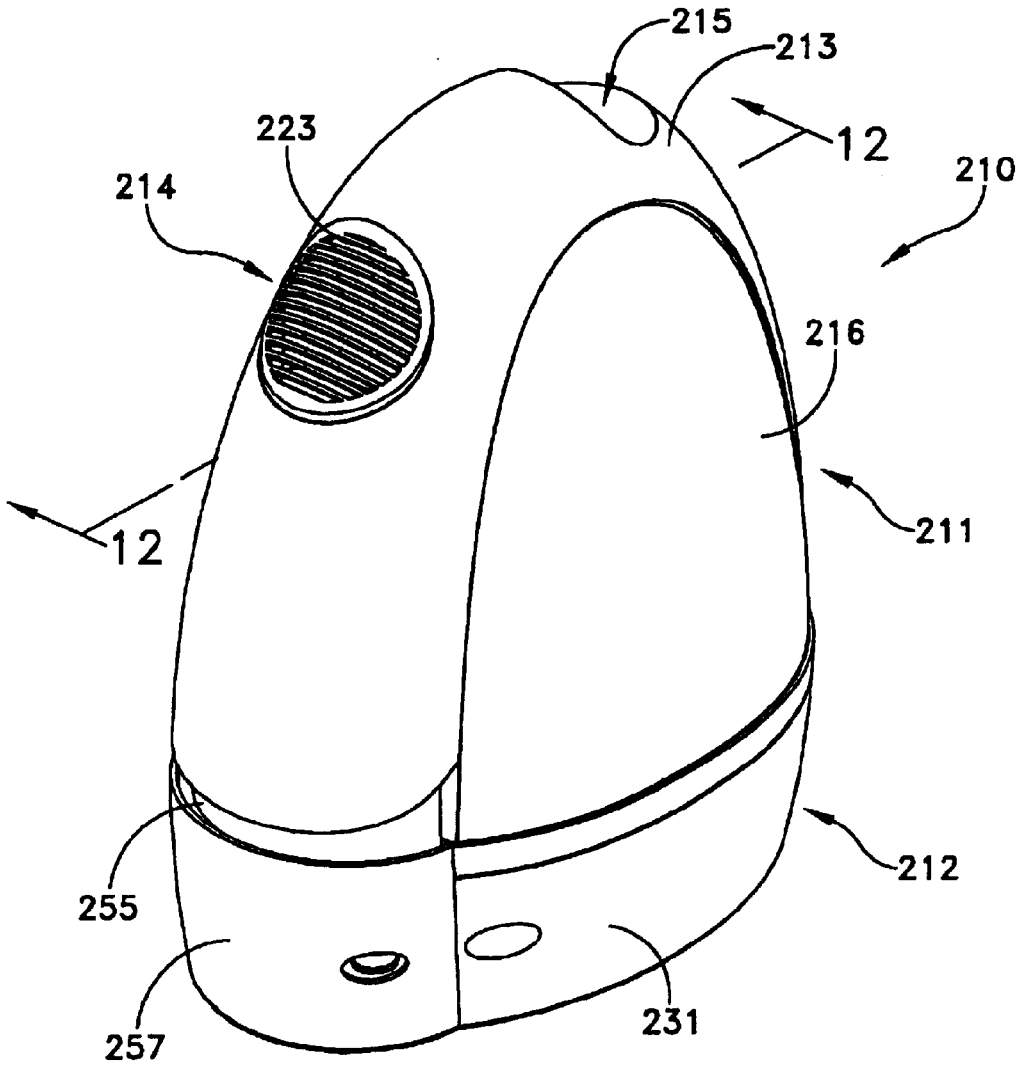
FIG. 11 is a perspective view of another embodiment of humidifier that incorporates this invention.
Figure 12:
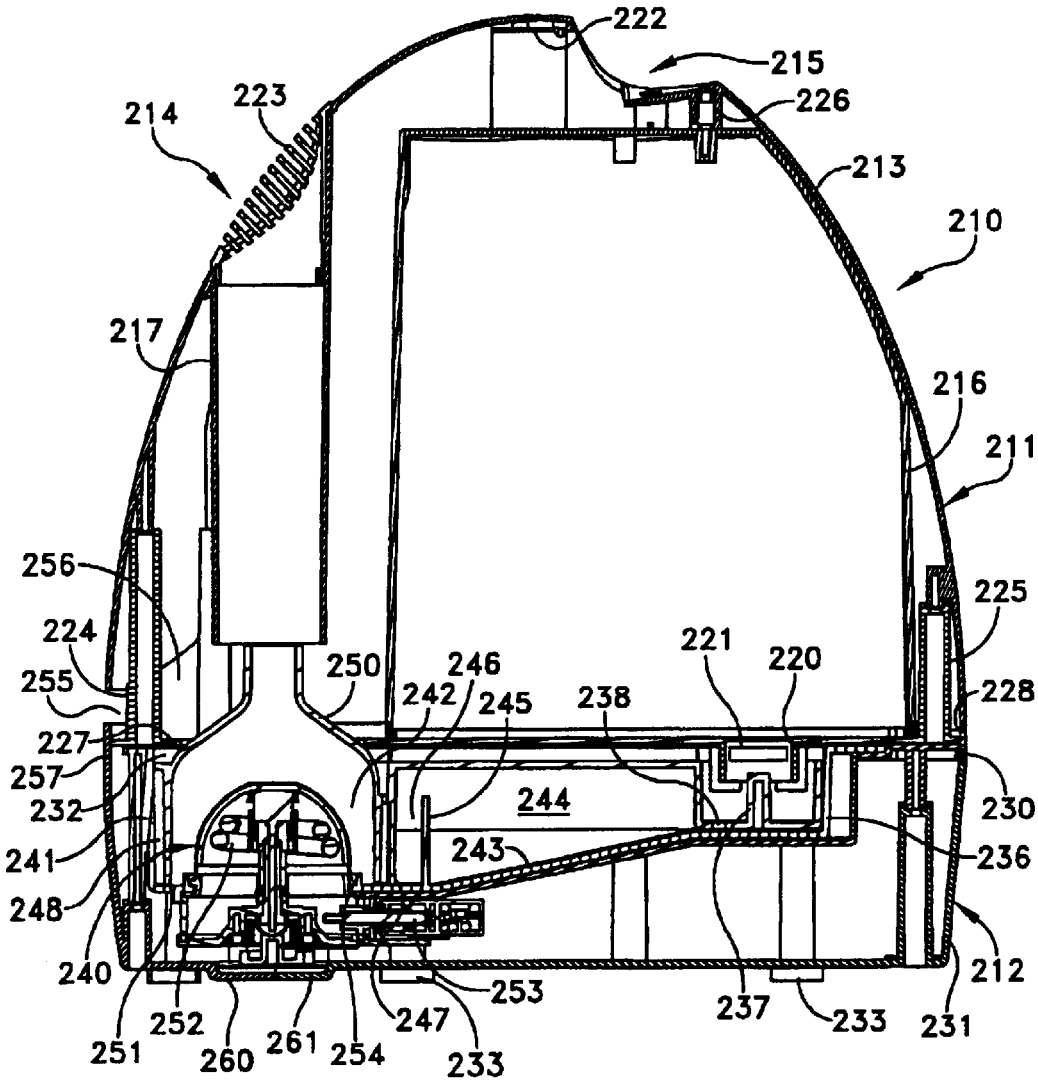
FIG. 12 is a cross-sectional view taken along lines 12—12 in FIG. 11.
Figure 13:
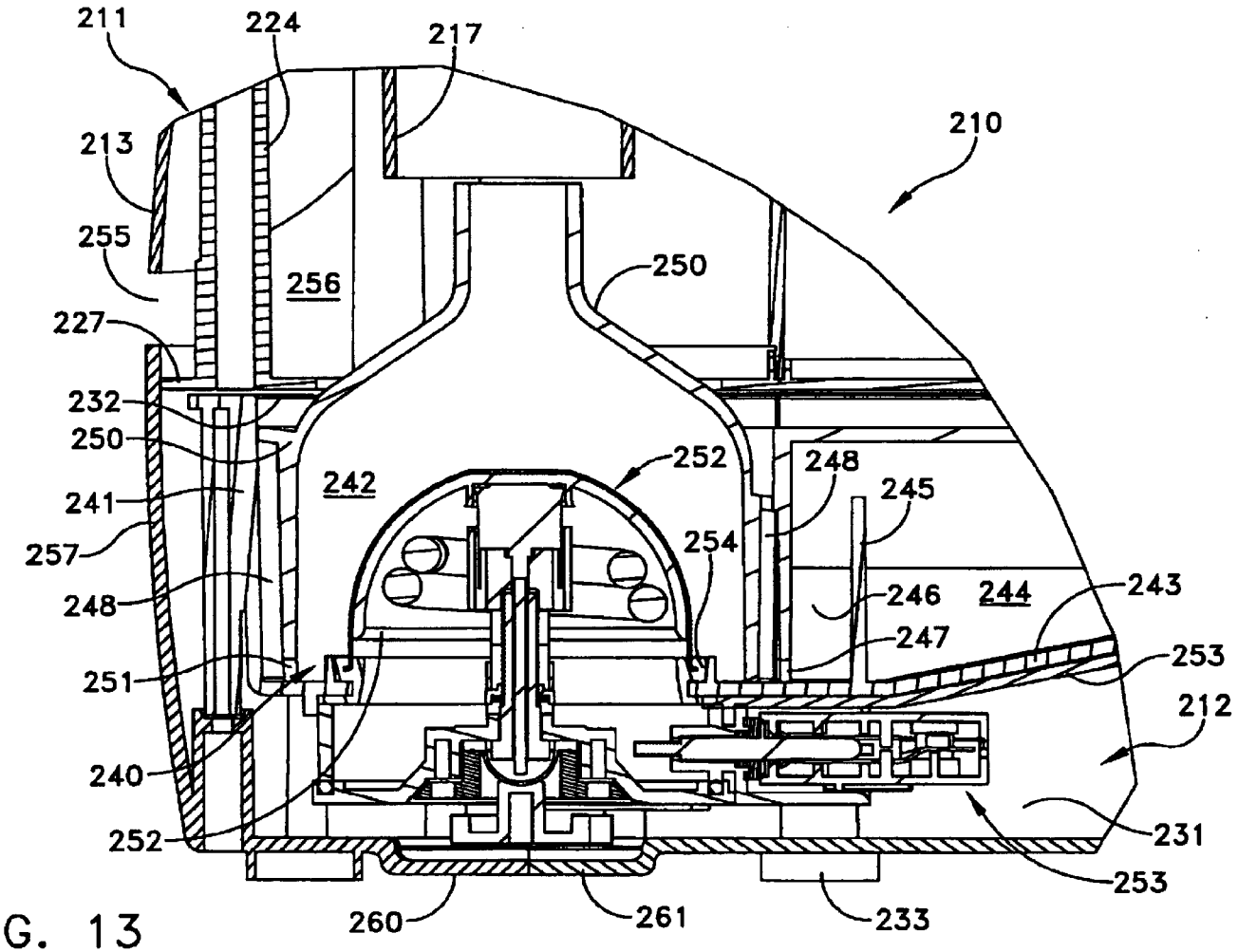
FIG. 13 is an enlarged cross-sectional view of a portion of the major assemblies of the humidifier in FIG. 12.

FIGS. 8 through 10 depict apparatus for distilling water. This apparatus 130 includes a base unit 131 with four chambers. A chamber 132 acts as a receiving position that receives a water tank 133. A removable steam generator 134 includes a steam dome 135 with a reduced diameter exhaust opening 136 and a heating module 137 all as described with respect to FIGS. 1 through 5. The removable steam generator is located in a lower chamber 138 that is at another receiving position.

FIG. 9 depicts a steam dome 135, that is similar in construction to the steam dome 30 in FIGS. 2 through 5. In the water distilling apparatus 130, however, a steam director unit 136 routes the steam through an elbow 137 attached to receive steam from the steam dome 135. The steam passes from the elbow 137 through a sliding seal bushing 140 to a conduit 141. The conduit 141 extends to a condensing coil 142 located in a third chamber 143 shown in FIGS. 8 through 10. A motor-driven fan 144 forces air over the condensing coil 142, shown here as a finned tube, to dissipate heat produced during the condensation process.

Referring to FIG. 10 the condensing coil 142 terminates in a conduit end (not shown) that directs distilled water from the condenser coil 142 to a water container 146 in a fourth chamber 147. The container 146 can be withdrawn from the fourth chamber 147 for providing the distilled water for any of a variety of purposes.

Thus, the apparatus in FIGS. 8 through 10 provides distilled water with apparatus that has all the cleaning and operating advantages as previously described with respect to the humidifier of FIGS. 1 through 7. More specifically, the specific embodiments in FIGS. 8 through 10 use the same basic structure including the same basic removable steam generator with its sealed heating module and removable steam dome. Both are readily cleaned and both provide the same basic operating advantages. The primary difference between the water distilling apparatus and the humidifier is the use of the mixing stack in the humidifier and the condenser coil 142 and related elements in the distiller.

FIGS. 11 through 14 depict an alternative embodiment of this invention that takes the form of a humidifier 210 using the same basic removable steam generator as shown in FIGS. 1 through 10. This humidifier 210 differs, however, by being designed in two assemblies, namely an upper removable assembly 211 and a lower support assembly 212.

The upper removable assembly 211 includes a concave shroud 213 with an exhaust opening 214 offset from the top of the concave shroud 213. A finger grip portion 215 allows an individual to lift the upper removable assembly 211 from the lower support assembly 212. The concave shroud 213 attaches to a water tank unit 216 that may be formed as a wholly or partially opaque, translucent or transparent structure. In this embodiment the shroud 213 is formed with a mixing stack 217 externally of the water tank unit 216.

Figure 14:
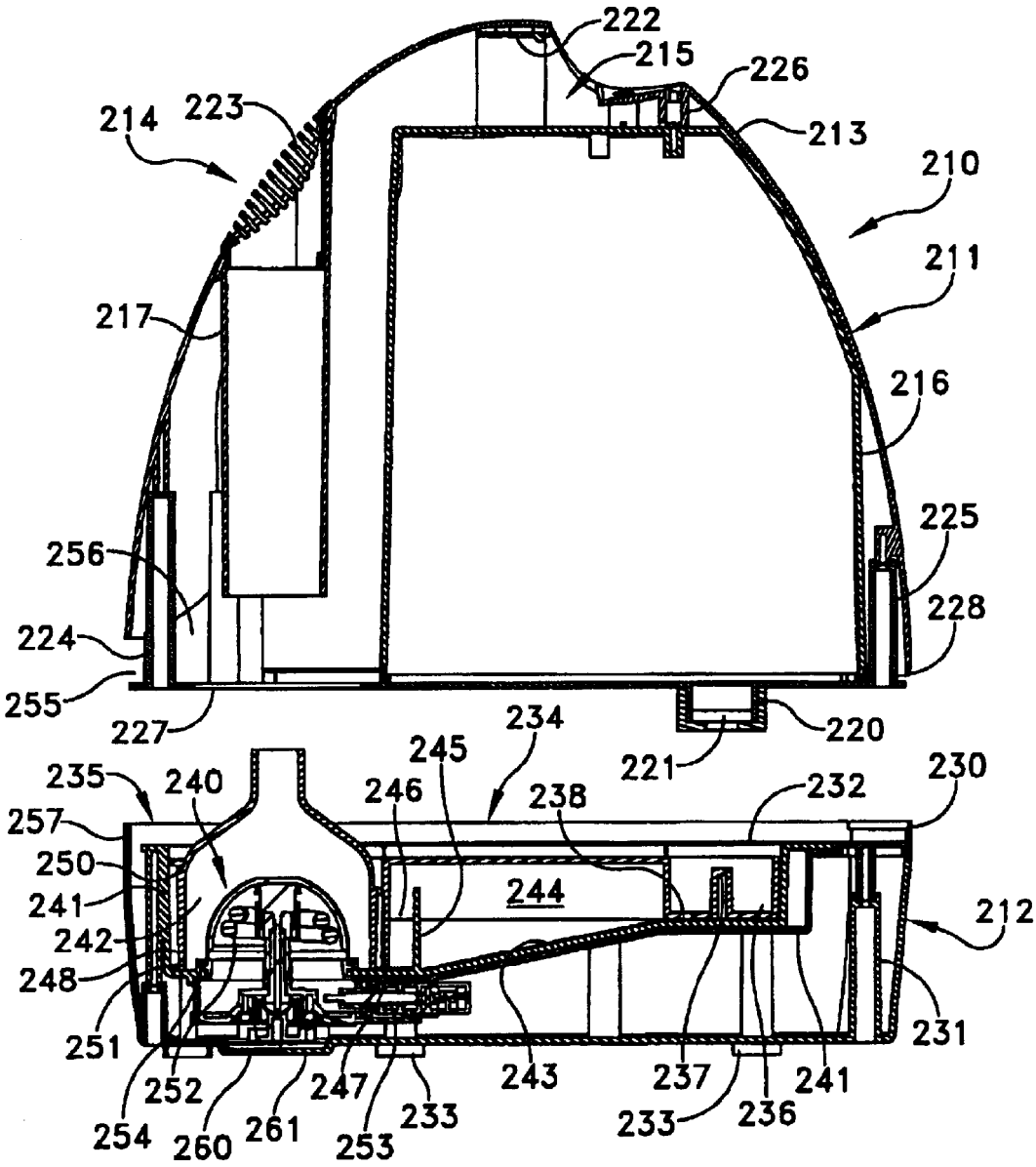
FIG. 14 is a cross-sectional view of the humidifier in FIG. 11 with a top unit separated from a bottom unit.

As shown most clearly in FIG. 14, the water tank unit 216 has a bottom spout 220 and valve 221. The bottom spout 220 and valve 221 allow an individual to invert and fill the water tank unit 216. Then, as the water tank unit 216 is returned to the orientation shown in FIG. 13, the valve 221 closes. This action prevents any water from escaping from the interior of the water tank unit 216 when it is separated from the lower support assembly 212.

The water tank unit 216 includes an internal saddle structure 224 at the top and positioned inwardly of the finger grip access portion 215. An individual can reach through the finger grip access portion 215 with one or two fingers to engage the saddle 224 and lift the entire upper removable assembly 211 including the water tank unit 216 with the connected shroud 213 and mixing stack 217, thereby separating the assemblies 211 and 212.

The shroud 213 carries a grill 223 that diffuses the airsteam mixture. In a preferred embodiment the grill 223 is removable. It could be replaced with other grill embodiments that might, for example, include a medicant reservoir.

As particularly shown in FIG. 14, the upper removable assembly 211 is an integral assembly comprising two major components. The first is a molded structure that forms the shroud 213 and the mixing stack 217. The shroud 213 also has structures, such as posts 224, 225 and 226, for affixing the shroud 213 to the water tank unit 216 by means of screws or the like that are not shown, but known in the art. Other fasteners or connections could also be used.

The open end of the shroud 213 terminates in a bottom structure 227 that allows the removable upper assembly 211 to rest on the lower support assembly 212. At some portions an internal lip and shoulder 228 is adapted to engage an external lip and shoulder 228 on the lower support assembly 212.

More specifically the lip and shoulder 230 are formed on a base unit 231 in the lower support assembly 212. The base unit 231 also has a support platform 232 near its upper edge. Feet 233 support the base unit 231 on a surface.

The base unit 231 defines a first receiving position 234 and a second receiving position 235. A well 236 with a center post 237 and an exit port 238 are located at the first receiving portion 234.

The lower support assembly 212 also locates a steam generator 240 at the second receiving position 235. The steam generator 240 includes a container 241 that receives water in a boiling chamber 242. An aqueduct 243 directs water from the well 236 to the boiling chamber 242. In this specific embodiment water from the well 236 passes through the exit port 238 into a gap between the bottom of the well 236 and the aqueduct 243. As shown most clearly in FIG. 13, as water flows across the aqueduct 243 it accumulates in a reservoir 244 until its level exceeds the height of a dam or barrier 245 and flows into a chamber 246. A passage 247 directs the water into an annular chamber 248 formed between a periphery of the container 241 and a chimney 250. Then water passes through a passage 251, preferably located diametrically from the passage across the second receiving position from the passage 247, to fill the boiling chamber 242. A semispherically-shaped immersion heater 252 is located in the boiling chamber 242 and is adapted for connection to power connections such as a releasable electrical connection 253. Such connections would be evident to person of ordinary skill in the art. A sealing structure 254 attaches the immersion heater to the container 241.

As may now be apparent from FIGS. 11 through 14 and the foregoing discussion, when the upper removable assembly 211 is placed on the support assembly 212, the water tank unit 216 is positioned over the first receiving portion 234 of the base unit 231 and the mixing stack 217 is positioned over the second receiving portion 235. This alignment can be assured by designing the peripheries of the concave shroud 213 and the base unit 231 to have a unique shape thereby to provide appropriate registration. As the upper removable assembly 211 is positioned on the support assembly 212, the post 237 opens the valve 221 and allows water to accumulate in the reservoir 244 and eventually fill the boiling chamber 242. As the immersion heater 240 boils the water, steam rises through the chimney 250 that is positioned immediately under the mixing stack 217 so that the steam mixes with air admitted through air port 255 and passage 256.

When it is desired to refill the tank or clean the immersion heater 240, it is merely necessary for an individual to lift the removable upper assembly 211 from the support assembly 212. Then the upper assembly 211 can be inverted to fill the tank. The steam generator 240 rests on rails (not shown) to form a subassembly with a drawer front 257 and a floor 260 that abuts a floor 261 of the base unit 231. The drawer front 257 can be withdrawn from the base unit 231 to the left in FIGS. 11 and 13 to provide access to the steam generator 240 for cleaning. Obviously this action also disconnects the power.

It will now be apparent that the humidifier 210 shown in FIGS. 11 through 14 meets all the objectives of this invention. More specifically, the humidifier 210 is formed with two basic assemblies; namely the lower support assembly 212 and the upper removable assembly 213. The lower support assembly 212 includes the base unit 231 with first and second displaced receiving positions 234 and 235 and a steam generator 240 at the second receiving position 235. The upper removable assembly includes the concave shroud 213 that engages the support assembly 212 in a predetermined relationship. The shroud 213 has an exhaust opening 214 in an upper portion thereof. The water tank unit 216 connects to the shroud 213 for alignment with the first receiving position 234. The mixing stack 217, that is external to the water tank unit 216, aligns with the steam generator at the second receiving position.

This invention has been disclosed in terms of a number of specific embodiments. It will be apparent that various modifications could be made to this invention. Other materials having the characteristics of stainless steel and aluminum might be substituted for each of those materials. Alternate embodiments of relationships between heat generating elements such as the two-turn coil 70 and the heat transferring structures formed by the first and second bodies 61 and 62 could also be provided. The particular structure of the steam generator 34 would be modified for other applications. The various figures disclose a humidifier wherein the steam generator assembly slides horizontally in the base unit during removal. As will be apparent, any of the embodiments, particularly the embodiment of FIGS. 11 through 14, can be readily adapted to allow the steam generator to be lifted vertically from the base unit by changing the configuration and location of the releasable electrical connection. Still many other variations could be incorporated in a specific implementation. Therefore, it is the intent of the appended claims to cover all such variations and modifications as come within the true spirit and scope of this invention.

What is claimed as new and desired to be secured by Letters Patent of the United States is:

1. A device that produces steam comprising:

A) a base unit including power connections and defining first and second receiving positions, B) a water tank unit for allowing water to exit said water tank when said water tank unit is installed at said first receiving position, and C) a removable steam generator at said second receiving position, said removable steam generator including:

i) a container that receives water in a boiling chamber, ii) an aqueduct for directing water from said water tank unit to said boiling chamber, iii) a semispherically shaped immersion heater located in said boiling chamber and adapted for connection to said power connections, and iv) a sealing structure for attaching said immersion heater to said container, and D) directing means attached to said steam generator for directing steam to an output of said device.

2. A device as recited in claim 1 wherein said immersion heater includes a first body formed from a material selected for its ability to conduct heat and a second body formed from material selected for its ability to resist permanent adherence of deposits from body liquid.

3. A device as recited in claim 2 wherein said first body is aluminum and said second body comprises stainless steel.

4. A device as recited in claim 3 wherein said stainless steel body additionally contains a portion that extends beyond said first body to form a skirt and a flange, said flange being attached to said container by said sealing structure and said skirt spacing said aluminum body from said container and said sealing structure.

5. A device as recited in claim 4 wherein said aluminum body forms a cavity and said heating element comprises a wrapped resistance heating unit attached to said first body in said cavity.

6. A device as recited in claim 5 additionally comprising temperature sensing means located in said cavity and in contact with said first body.

7. A device as recited in claim 2 wherein said steam generator additionally includes a chimney structure that circumscribes said boiling chamber and overlies said immersion heater, said directing means receiving the steam from said boiling chamber through said chimney structure.

8. A device as recited in claim 7 wherein said directing means forms a stack aligned with said chimney structure, said stack including an inlet opening for receiving air and an exhaust opening, the steam from said chimney structure passing through said stack and mixing with air from said inlet opening for discharging humidified air from said exhaust opening.

9. A device as recited in claim 7 wherein said device additionally comprises means for condensing steam to form distilled water and said directing means connects to said condensing means thereby to direct the steam directly to said condensing means.

10. A humidifier comprising:

A) a base unit including power connections arid controls and defining first and second receiving positions, B) a water tank unit for allowing water to exit said water tank unit when said water tank unit is installed at said first receiving position, C) a removable steam generator at said second receiving position, said removable steam generator including:

i) a container that receives water, ii) an immersion heater located in said container and connected to said power connections, iii) a chimney with a first end that circumscribes said immersion heater to define a boiling chamber and a second end with an exhaust opening, and iv) means for conveying water from said water tank unit to said boiling chamber, and D) a mixing stack having a first end aligned with said chimney and an exhaust opening at a second end thereof whereby steam from said chimney mixes with air in said stack to be discharged as humidified air from said exhaust opening.

11. A humidifier as recited in claim 10 said connection between said power connections and said immersion heater comprises complementary releasable electrical connection elements on said base unit at said second receiving position and on said removable steam generator whereby said steam generator is devoid of any components that can be damaged by being immersed in water when it is removed from said base unit.

12. A humidifier as recited in claim 11 wherein said first end of said chimney rests on maid container when said steam generator is located at said second receiving position, said chimney being separable from said container when said steam generator is separated from said second receiving position.

13. A humidifier as recited in claim 12 wherein said container includes wall means defining an enclosed portion and said chimney rests in said container in a spaced relationship with respect to said wall means, said chimney having a passage therethrough for enabling water to pass into said boiling chamber.

14. A humidifier as recited in claim 12 wherein said chimney has a substantially cylindrical cross section and said humidifier additionally includes a radially extending aqueduct and a well located by said aqueduct under said water tank unit whereby said aqueduct directs water from said water tank unit into the space between said wall means and said chimney.

15. A humidifier as recited in claim 14 wherein said water tank unit has a valve and said chimney well includes a post for releasing said water tank valve thereby to enable water to enter said aqueduct.

16. A humidifier as recited in claim 11 additionally comprising components on said base unit at said second receiving position and on said removable steam generator thereby to facilitate the insertion and removal of said steam generator into and from said second receiving position.

17. A humidifier as recited in claim 11 wherein said base unit includes means at said first receiving position for positioning said water tank unit on said bane unit whereby said water tank unit can be removed from said base unit.

18. A humidifier as recited in claim 11 wherein the first receiving position of said base unit includes at least two receptacles and wherein each of said receptacles includes a separate one of said water tanks.

19. A humidifier as recited in claim 10 wherein said base unit and removable steam generator form a first assembly and said water tank unit and said mixing stack form a second assembly that is removable from said first assembly.

20. A humidifier as recited in claim 19 wherein said second assembly includes a shroud with an opening therethrough, an integral mixing stack aligned with said opening and an integral water tank.

21. A humidifier comprising:

A) a support assembly with a base unit having first and second displaced receiving positions and a steam generator in said base unit at the second receiving position, and B) a removable upper assembly including:

i) a shroud for engaging said support assembly in a predetermined relationship and having a port at an upper portion thereof, ii) a water tank unit connected to said shroud for alignment with the first receiving position, and iii) a mixing tube extending from said port to align with said steam generator and being external to said water tank unit, whereby said upper assembly is readily removable from said support assembly for filling the water tank unit and cleaning the steam generator.

22. A humidifier as recited in claim 21 wherein said steam generator is removable from said support assembly.

23. A humidifier as recited in claim 21 wherein said water tank unit has a port that is aligned with a well in said support assembly at the first receiving position to allow the water to transfer to said steam generator.

24. A humidifier as recited in claim 23 wherein said steam generator unit includes a labyrinthal passage for directing water from said well to said steam generator.

25. A humidifier as recited in claim 23 wherein said steam generator unit includes a container for receiving water from said water tank unit and an immersion heater located in said container and spaced therefrom and a labyrinthal passage for transferring water from said well to a chamber formed between said container and said immersion heater.

26. A humidifier as recited in claim 25 wherein said steam generator is removable from said support assembly.

* * * * *